US006701113B2

(12) United States Patent
Matsuda et al.

(10) Patent No.: US 6,701,113 B2
(45) Date of Patent: Mar. 2, 2004

(54) DEVELOPER CARRYING MEMBER, DEVELOPER REPLENISHMENT CONTAINER AND IMAGE FORMING APPARATUS

(75) Inventors: Kenji Matsuda, Shizuoka (JP); Akiyoshi Fujita, Shizuoka (JP); Nobuharu Hoshi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,333

(22) Filed: Mar. 27, 2002

(65) Prior Publication Data

US 2002/0150410 A1 Oct. 17, 2002

(30) Foreign Application Priority Data

Mar. 30, 2001 (JP) ..... 2001/100580

(51) Int. Cl.[7] ..... G03G 15/08
(52) U.S. Cl. ..... 399/263; 399/258
(58) Field of Search ..... 222/DIG. 1; 399/111, 399/119, 254, 256, 258, 262, 263

(56) References Cited

U.S. PATENT DOCUMENTS 5,655,195 A * 8/1997 Ichikawa et al. ..... 399/263

6,229,979 B1 5/2001 Ishii et al. ..... 399/281

* cited by examiner

*Primary Examiner*—Hoang Ngo

(74) *Attorney, Agent, or Firm*—Fitzpatrick, Cella, Harper & Scinto

(57) ABSTRACT

A developer carrying member includes: a rotation shaft portion; a first carrying member for carrying developer, the first carrying member being formed on the rotation shaft portion; and a second carrying member for carrying the developer, the second carrying member being formed on the rotation shaft portion on a downstream side in a developer carrying direction. The second carrying member is equipped with a carrying surface having an intersection angle with respect to a lengthwise direction of the rotation shaft portion in a state such that no load is applied to the second carrying member, and such that the second carrying member does not abut against an inner wall of a developer containing container. The first and the second carrying members carry the developer in a lengthwise direction by rotation of the rotation shaft portion. A rigidity of the second carrying member is larger than a rigidity of the first carrying member.

30 Claims, 7 Drawing Sheets

DEVELOPER CARRYING MEMBER, DEVELOPER REPLENISHMENT CONTAINER AND IMAGE FORMING APPARATUS

BACKGROUND OF THE INVENTION

1. Field of the Invention

The present invention relates to a developer carrying member, a developer replenishment container and an image forming apparatus provided with the developer carrying member and the developer replenishment container.

2. Related Background Art

Toner is conventionally used for an electrophotographic image forming apparatus such as an electrophotographic copying machine, a printer and the like as a developer. The toner is contained in a developer replenishment container including a developer containing portion and a developer delivery portion. A user uses the electrophotographic image forming apparatus by attaching the developer replenishment container to the apparatus.

When the toner in the replenishment container is consumed, the developer replenishment container is replaced with another developer replenishment container that is filled with toner or a brand-new developer replenishment container. Thereby, the replenishment work of toner can be simplified.

On the other hand, a process cartridge system has been adopted. The process cartridge system integrates an electrophotographic photosensitive member, a charging means, a developing means, a cleaning means and the like to be a cartridge. Then, the process cartridge system makes the cartridge detachably attachable to the main body of an image forming apparatus.

Because a user can perform the maintenance of an electrophotographic image forming apparatus by himself or herself without requesting a service person to perform the maintenance by using the apparatus employing the process cartridge system, the operational property of the apparatus can remarkably be improved. Consequently, the process cartridge system has widely been used by electrophotographic image forming apparatus.

Moreover, the cartridge configuration in which process means having long lives and process means having short lives are respectively made to be a cartridge for enabling a user to use the cartridges according to their lives has also been realized. For example, a developing cartridge formed by the integral configuration of a developer containing portion and a developing means, a drum cartridge formed by the integral configuration of an electrophotographic photosensitive member, a charging means and a cleaning means, and the like are employed.

Now, because toner is very fine powder, a method for preventing the scattering of the toner at the time of a developer replenishment work is known. In the method, a developer feeding container is placed in the inside of the main body of an image forming apparatus, and then the toner is delivered from a developer delivery port being a small opening portion to a developer feeding opening of a feed destination by a small amount.

Because it is difficult to deliver the toner naturally by the operation of gravity or the like in such a method, the method needs some developer carrying means.

Moreover, the method is effective in replenishing developer neither too much nor too less and in keeping the amount of the developer in a developing apparatus and the mixing ratio of the carrier component and the toner component of a two-component developer at a constant level.

Although the so-called placing type developer replenishment container is effective in stabilizing the level of the mixing ratio of the carrier component and the toner component of a two-component developer, the requirement of stabilizing the level of the mixing ratio has become strict more and more as the image qualities of recent electrophotographic image forming apparatus have become high.

SUMMARY OF THE INVENTION

The present invention was made in view of the aforesaid situation, and one of the objects of the invention is to provide a developer carrying member, a developer replenishment container and an image forming apparatus, all being capable of realizing the compatibility of their constant amount delivery properties of developer with the decrease of residual toner cheaply.

For the achievement of the aforesaid object, the present invention provides a developer carrying member includes: a first carrying member for carrying developer, the first carrying member being formed on a rotation shaft portion; and a second carrying member for carrying the developer, the second carrying member being formed on the rotation shaft portion on a downstream side in a developer carrying direction; wherein the first and the second carrying members carry the developer in a lengthwise direction of the rotation shaft portion by rotation of the rotation shaft portion, and rigidity of the second carrying member is higher than that of the first carrying member.

Moreover, the present invention is a developer replenishment container and an image forming apparatus, both including the aforesaid developer carrying member.

DETAILED DESCRIPTION OF THE PREFERRED EMBODIMENTS (Description of Whole Image Forming Apparatus)

Figure 1:
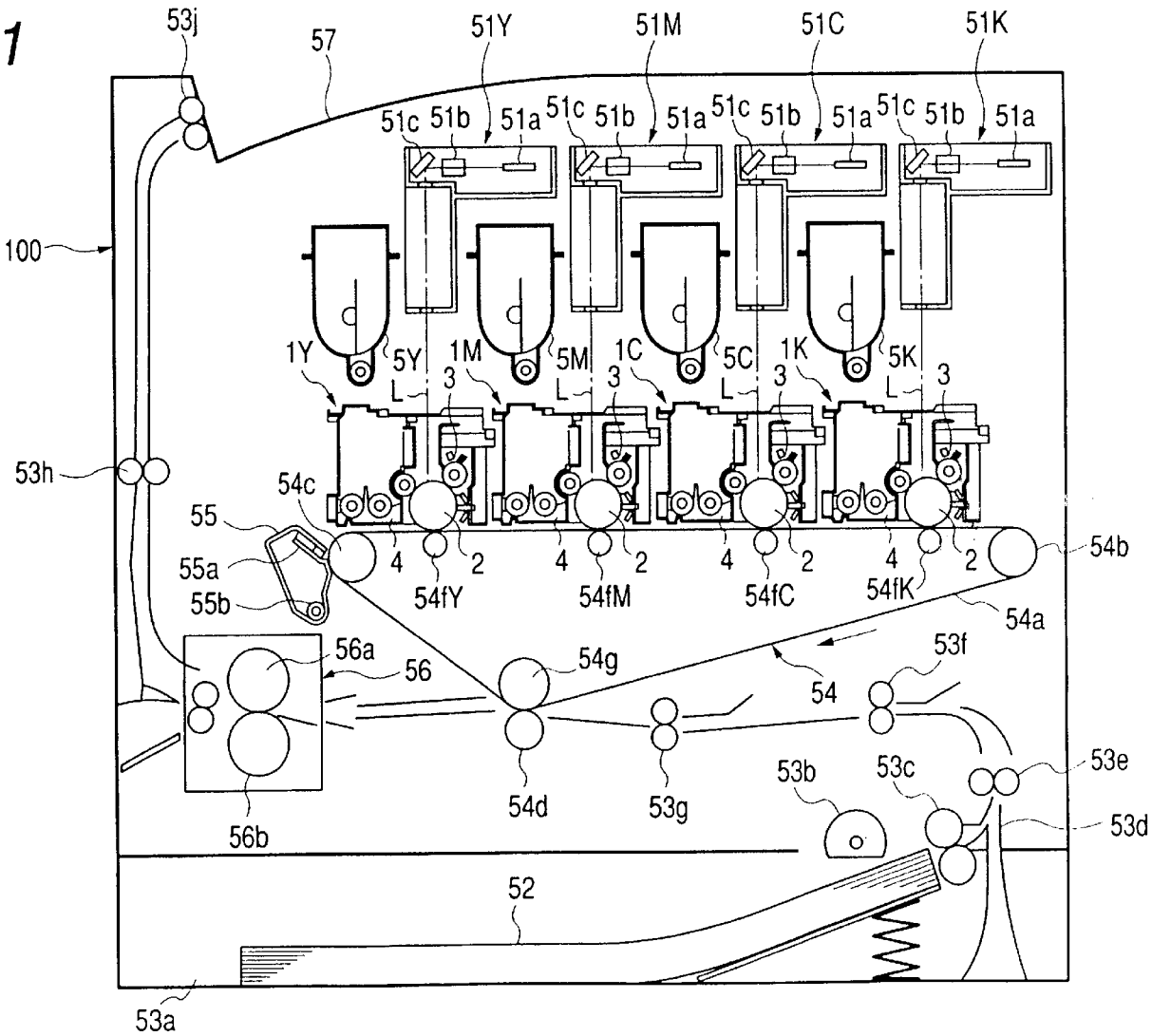
FIG. 1 is a longitudinal section of an image forming apparatus, i.e., a color laser beam printer, according to the present invention.

FIG. 1: the whole configuration of a color laser beam printer

The image forming portion of the color laser beam printer shown in FIG. 1 is provided with four process cartridges 1Y (yellow), 1M (magenta), 1C (cyan) and 1 K (black), which are severally equipped with a photosensitive drum 2 being an image bearing body, and exposing means (or laser beam optical scanning systems) 51Y, 51M, 51C and 51K disposed parallel with one another correspondingly to each color at the upper part of the process cartridge 1 (1Y, 1M, 1C and 1K).

Below the image forming portion, the color laser beam printer disposes a feeding means for feeding a recording medium 52, an intermediate transfer belt 54*a* for transferring toner images formed on the photosensitive drums 2, a secondary transferring roller 54*d* for transferring a toner image on the intermediate transfer belt 54*a,* a fixing device 56 for fixing the transferred toner image on the recording medium 52, and delivery rollers 53*h* and 53*j* for delivering the recording medium 52 to the outside of the color laser beam printer to stack the delivered recording medium 52.

Hereupon, a blank, an overhead projector (OHP) sheet, a piece of cloth, and the like are used as the recording medium 52.

Now, the color laser beam printer of the present embodiment employs a cleanerless system. The printer takes the transfer residual toner remaining on the photosensitive drums 2 into developing apparatus 4, and no dedicated cleaners for collecting and storing the transfer residual toner are disposed in the process cartridge 1 (1Y, 1M, 1C and 1K).

Next, the configurations of the aforesaid respective portions are minutely described in turn.

(Feeding Means)

The feeding means feeds the recording medium 52 to the image forming portion. The feeding means is mainly composed of a feeding cassette 53*a* containing a plurality of stacked recording media 52, a feeding roller 53*b,* retard rollers 53*c* for preventing double feeding, a feeding guide 53*d* and registration rollers 53*g.*

The feeding roller 53*b* is driven to rotate according to the image forming operation of the printer for separating and feeding the recording media 52 in the feeding cassette 53*a* one by one. The double feeding of the recording media 52 is prevented by the retard rollers 53*c.* A separated recording medium 52 is guided by the feeding guide 53*d,* and the recording medium 52 is then conveyed to the registration rollers 53*g* through conveying rollers 53*e* and 53*f.*

The registration rollers 53*g* execute a non-rotation operation for making the recording medium 52 stand still to wait and a rotation operation for conveying the recording medium 52 toward the intermediate transfer belt 54*a* in a predetermined sequence during the image forming operation for the registration of a toner image and the recording medium 52 at the time of a transfer process being the next process.

Incidentally, the registration rollers 53*g* are stopping its rotation immediately after the conveyance of the recording medium 52. The recording medium 52 collides with the nip portion of the registration rollers 53*g,* and thereby the skew feeding of the recording medium 52 is corrected.

(Process Cartridge)

A process cartridge 1 (1Y, 1M, 1C or 1K) is provided with an electrifier 3 and a developing apparatus 4, both being disposed around a photosensitive drum 2 being an image bearing member, and the electrifier 3, the developing apparatus 4 and the photosensitive drum 2 are integrally configured. A user can easily detach the process cartridge 1 (1Y, 1M, 1C or 1K) from the main body 100 of the printer. The user can replace the process cartridge 1 (1Y, 1M, 1C or 1K) with new one when the life of the photosensitive drum 2 completes its span.

The present embodiment, for example, counts the number of the rotations of the photosensitive drum 2, and informs the completion of the span of the life of the process cartridge 1 (1Y, 1M, 1C or 1K) when the counted number exceeds a predetermined count number.

The photosensitive drum 2 of the present embodiment is constructed of an organic photosensitive member, which is charged to be negative. The photosensitive drum 2 includes an aluminum drum base in the shape of a hollowed cylinder having a diameter of about 30 mm, and a photosensitive layer formed on the drum base. The photosensitive layer is formed with an ordinarily used material. A charge injecting layer is formed as the outermost layer of the photosensitive drum 2. The photosensitive drum 2 is driven to rotate at an ordinary process speed (about 117 mm/sec in the present embodiment). Incidentally, the charge injection layer is formed as a painted layer of a material composed of, for example, ultra-fine particles of tin dioxide ($SnO_2$) as electrically conductive fine particles and a binder of an insulating resin, in which the ultra-fine particles are dispersed.

Figure 4:
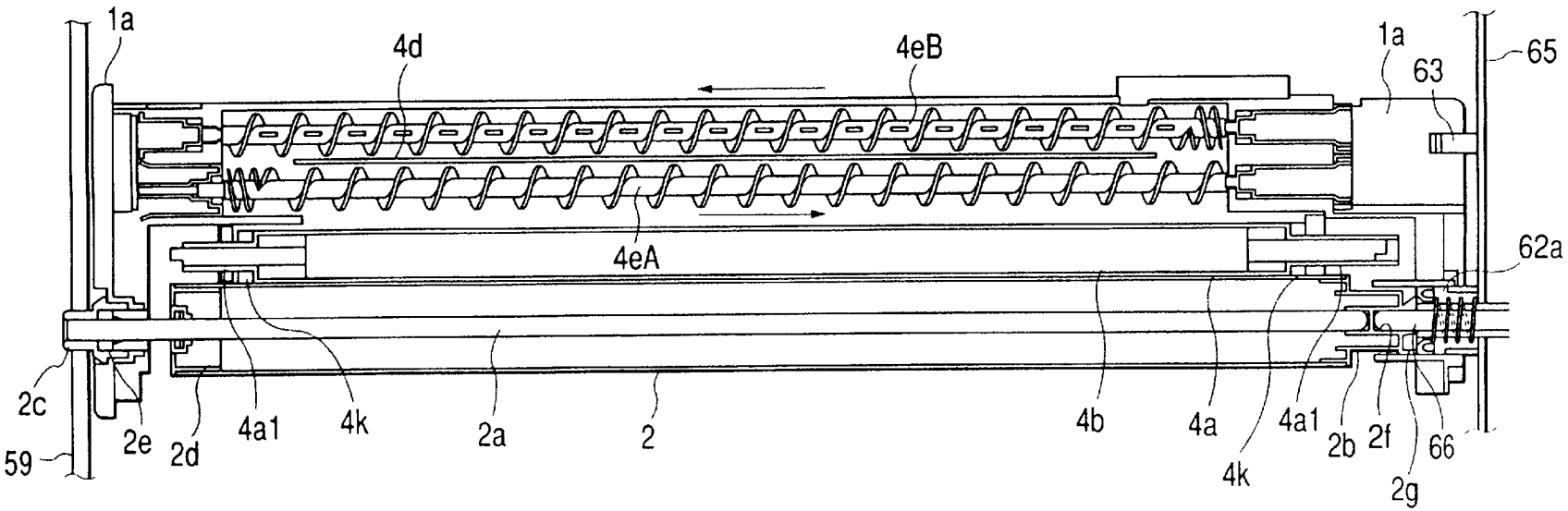
FIG. 4 is a lengthwise direction transverse section of the process cartridge.

As shown in FIG. 4, a drum flange 2*b* is fixed at the end portion on the rear side in the lengthwise direction (or the end portion on the right side in FIG. 4) of the drum base 2*h* of the photosensitive drum 2, and a driven flange 2*d* is fixed at the end portion on the front side (or the end portion on the left side in FIG. 4). A drum shaft 2*a* penetrates through the centers of the drum flange 2*b* and the driven flange 2*d,* and the drum shaft 2*a* engages with the driven flange 2*d* such that the drum shaft 2*a* and the driven flange 2*d* integrally rotate. Then, the drum base 2*h,* the drum shaft 2*a,* the drum flange 2*b* and the driven flange 2*d* integrally rotate. That is, the photosensitive drum 2 rotates around the shaft center of the drum shaft 2*a.*

Moreover, the end portion on the front side of the drum shaft 2*a* is supported by a bearing 2*e* rotatably. The bearing 2*e* is fixed to a bearing case 2*c.* Then, the bearing case 2*c* is fixed to the frame 1*a* of the process cartridge 1 (1Y, 1M, 1C or 1K).

(Charging Means)

Figure 2:
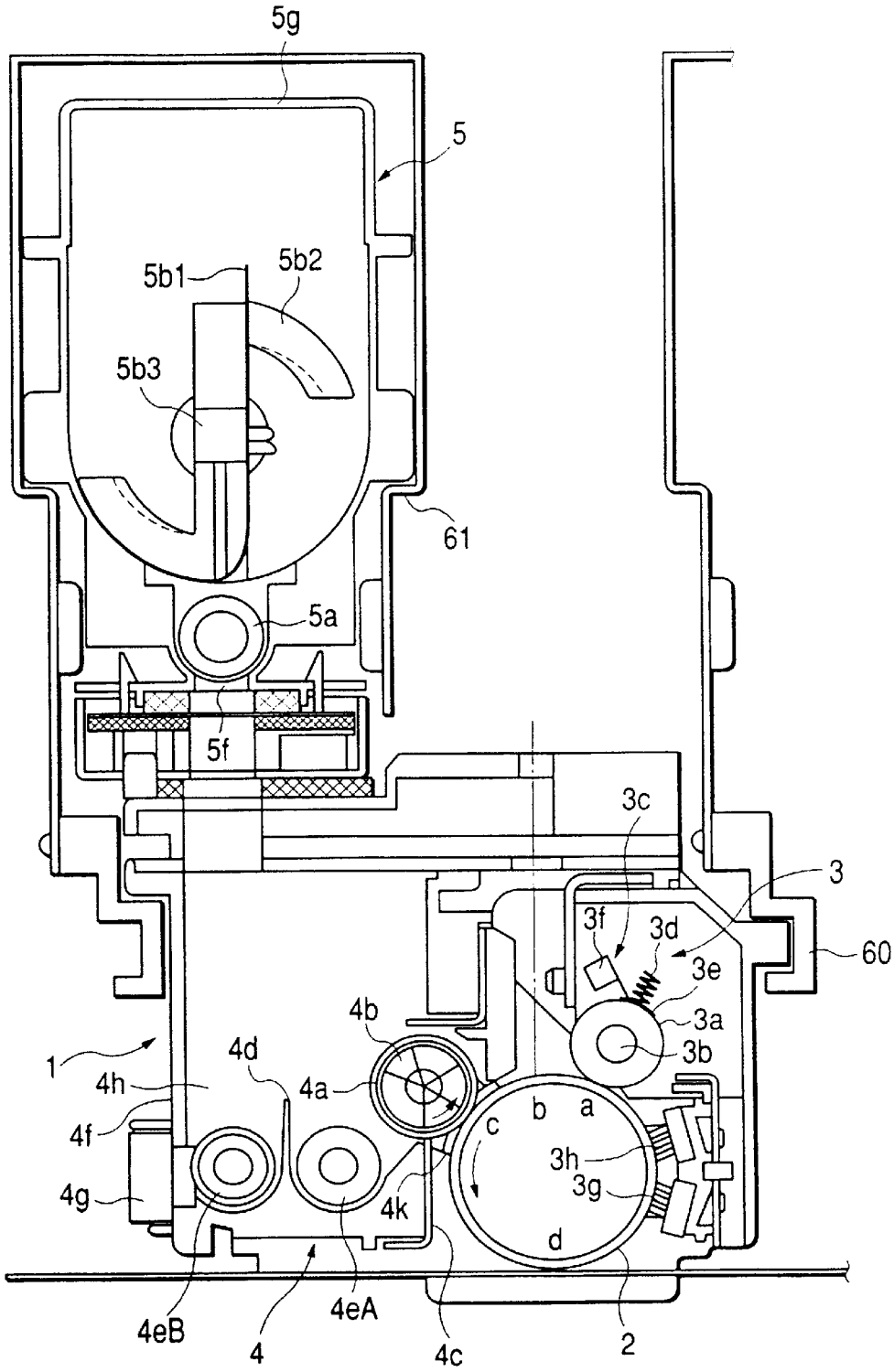
FIG. 2 is a longitudinal section of a process cartridge and a developer replenishment container.

FIG. 2: a touch charging process using a charging roller 3*a* as the charging means in the present embodiment The charging roller 3*a* is provided with a metal core 3*b*. Both end portions of the core metal 3*b* are rotatably held by not shown bearing members. The charging roller 3*a* is energized in the direction of the photosensitive drum 2 by means of a helical compression spring 3*d*. The charging roller 3*a* is thereby pressed to the surface of the photosensitive drum 2 with a predetermined pressing force. Then, the charging roller 3*a* rotates by following the rotation of the photosensitive drum 2.

A reference numeral 3*c* designates a cleaning member of the charging roller 3*a.* The cleaning member 3*c* is composed of a supporting member 3*f* and a flexible cleaning film 3*e* attached to the supporting member 3*f.* The cleaning film 3*e* is disposed along the lengthwise direction of the charging roller 3*a* in parallel with the charging roller 3*a.* One end of the cleaning film 3*e* is fixed to the supporting member 3*f,* which performs a reciprocating motion in the lengthwise direction in a predetermined range. The cleaning film 3*e* is disposed such that the surface near to the free end of the cleaning film 3*e* forms a contact nip with the charging roller 3*a.* The supporting member 3*f* is driven by a not shown driving means to reciprocate in the lengthwise direction in the predetermined range. Then the cleaning film 3*e* abrasively slides on the surface of the charging roller 3*a.* Thereby, adhering materials such as fine particle toner or an extraneous addition agent on the surface of the charging roller 3*a* are removed.

Now, the color laser beam printer according to the present embodiment employs the cleanerless system that is described in the following.

(Cleaner-Less System)

In the cleanerless system employed in the present embodiment, transfer residual toner on the photosensitive drum 2 after transferring passes through a charging portion "a" and an exposing portion "b" as the photosensitive drum 2 successively rotates. Then the transfer residual toner is brought to a developing portion "c". At the developing portion "c", the developing apparatus 4 performs the cleaning (or collection) of the transfer residual toner while performing development.

Because the transfer residual toner on the surface of the photosensitive drum 2 passes through the exposing portion "b", an exposing process is performed through the transfer residual toner. However, because the amount of the transfer residual toner is small, no serious influences are exerted on the exposing process. However, there are various transfer residual toners such as the toner having a normal polarity, the toner having a reversed polarity (or a reversed toner), and the toner having a small electrification amount. These transfer residual toners are mixed to each other. Consequently, it is considerable that imperfect electrification of the photosensitive drum 2 is produced if the charging roller 3*a* is intolerably contaminated by the toner by the attachment of the reversed toner or the toner having the small electrification amount among the various transfer residual toners to the charging roller 3*a* when the reversed toner or the toner having the small electrification amount passes through the charging portion "a".

Moreover, in order that the developing apparatus 4 may effectively perform the cleaning of the transfer residual toner on the photosensitive drum 2 while performing development, it is necessary that the polarity of the electrification of the transfer residual toner, which is brought to the developing portion "c", on the photosensitive drum 2 is normal, and that the electrification amount of the transfer residual toner is sufficient for the developing apparatus 4 to develop an electrostatic latent image on the photosensitive drum 2. The reversed toner and the toner having an unsuitable electrification amount cannot be removed and collected from the photosensitive drum 2 to the developing apparatus 4, and the toners have been a cause of the formation of an imperfect image.

Moreover, because the needs of users have recently been diversified, a continuous printing operation of a high coverage rate image such as a photograph image or the like and other similar operations have come to be performed. Such operations produce a large quantity of transfer residual toner per an operation. Consequently, the aforesaid problems are further promoted.

Accordingly, the present embodiment is provided with a transfer residual toner (residual developer image) averaging means 3*g* for averaging transfer residual toner on the photosensitive drum 2. The transfer residual toner averaging means 3*g* is disposed at a position on the downstream side in the rotation direction of the photosensitive drum 2 from the transferring portion "d". The present embodiment is further provided with a toner (or a developer) electrification controlling means 3*h* for arranging the electrification polarity of the transfer residual toner to be a negative polarity being the normal polarity. The toner electrification controlling means 3*h* is disposed at a position on the downstream side in the rotation direction of the photosensitive drum 2 from the transfer residual toner averaging means 3*g* and on the upstream side in the rotation direction of the photosensitive drum 2 from the charging portion "a".

By the provision of the transfer residual toner averaging means 3*g*, even if much transfer residual toner is brought from the transferring portion "d" to the toner electrification controlling means 3*h* in a shape of a pattern on the photosensitive drum 2, the transfer residual toner is dispersed to be distributed in a non-patterned manner on the surface of the photosensitive drum 2. Consequently, the concentration of toner to a part of the toner electrification controlling means 3*h* does not come to happen, and then the overall normal polarity electrification processing of transfer residual toner is always sufficiently performed by the toner electrification controlling means 3*h*. Consequently, the attachment of the transfer residual toner to the charging roller 3*a* can effectively be prevented, and the generation of a ghost image of the transfer residual toner image pattern can also be prevented.

In the present embodiment, the transfer residual toner averaging means 3*g* and the toner electrification controlling means 3*h* are made of a brush-like member having suitable electrical conductivity. The transfer residual toner averaging means 3*g* and the toner electrification controlling means 3*h* are disposed such that their brush portions are in contact with the surface of the photosensitive drum 2.

Moreover, the transfer residual toner averaging means 3*g* and the toner electrification controlling means 3*h* are configured to move (in a reciprocating motion) along the lengthwise direction of the photosensitive drum 2 by a not shown driving source. In such a configuration, the transfer residual toner averaging means 3*g* and the toner electrification controlling means 3*h* do not continue to be being located at the same position on the photosensitive drum 2. Consequently, even if an overcharged portion or an undercharged portion exist on the photosensitive drum 2 owing to, for example, the unevenness of the resistance of the toner electrification controlling means 3*h*, the portions are not always produced at the same portions on the photosensitive drum 2. Consequently, it can be prevented or relaxed that fusion is produced on the photosensitive drum 2 owing to local overcharging of transfer residual toner or that the transfer residual toner adheres to the charging roller 3*a* owing to undercharging.

(Exposing Means)

In the present embodiment, exposure to a photosensitive drum 2 is performed by means of a laser exposing means 51 (51Y, 51M, 51C or 51K). That is, when an image signal is transmitted from the main body 100 of the printer to the exposing means 51, the exposing means 51 scans the uniformly electrified surface of the photosensitive drum 2 to expose the surface with a laser beam L modulated in accordance with the signal. Then, an electrostatic latent image corresponding to the image signal is selectively formed on the photosensitive drum 2.

As shown in FIG. 1, the laser exposing means 51 (51Y, 51M, 51C or 51K) is composed of a not shown solid state laser device, a polygon mirror 51*a*, an imaging lens 51*b*, a reflecting mirror 51*c*, and the like. The light emission of the solid state laser device is controlled to be turned on or off at a prescribed timing by a not shown light emission signal generator on the basis of the input image signal. The laser beam L emitted from the solid state laser device is converted to a substantially parallel light flux by a not shown collimator lens system, and the collimated light flux is scanned by the polygon mirror 51*a*. And then, the scanned light flux is imaged like a spot on the photosensitive drum 2 through the imaging lens 51*b* and the reflecting mirror 51*c*.

Thus, on the photosensitive drum 2, the exposure in the main direction by the scanning of the laser beam L and the exposure in the subsidiary direction by the rotation of the photosensitive drum 2 are performed, and an exposure distribution according to the image signal can be obtained. That is, a bright portion electric potential where the surface electric potential is decreased and a dark portion electric potential where the surface electric potential is not decreased are formed on the photosensitive drum 2 by the irradiation and the non-irradiation of the laser beam L. Then, an electrostatic latent image in accordance with the image signal is formed on the photosensitive drum 2 to be a contrast between the bright portion electric potential and the dark portion electric potential.

(Developing Means)

The developing apparatus 4 being the developing means is a two-component contact developing apparatus (or a two-component magnetic brush developing apparatus). As shown in FIG. 2, the developing apparatus 4 holds developer composed of a carrier and a toner on a development sleeve 4*a* being a developer carrying body with a magnet roller 4*b* built therein. The development sleeve 4*a* constitutes the developing means. A regulating blade 4*c* is disposed at a position distant from the development sleeve 4*a* by a predetermined interval. A thin layer of the developer is formed on the development sleeve 4*a* as the development sleeve 4*a* rotates in the direction indicated by an arrow. Incidentally, although the present embodiment uses the two-component magnetic brush developing apparatus as the developing apparatus 4, the developing apparatus 4 is not restricted to the two-component magnetic brush developing apparatus.

As shown in FIG. 4, spacers 4*k* in the shape of a roller are rotatably fitted to reduced journal portions 4*a*1 on both the end sides. Thereby, the development sleeve 4*a* is disposed to form a predetermined interval from the photosensitive drum 2. The development sleeve 4*a* is set to develop an electrostatic latent image on the photosensitive drum 2 with the thin layer of the developer formed on the development sleeve 4*a* being contacted with the photosensitive drum 2. And, as shown in FIG. 2, the development sleeve 4*a* is driven to rotate at a predetermined peripheral velocity in the direction indicated by an arrow in FIG. 2 (or the counter-clockwise direction) such that the peripheral surface of the development sleeve 4*a* moves in the direction counter to the moving direction of the peripheral surface of the photosensitive drum 2 at the developing portion "c" (see FIG. 2).

In the present embodiment, a negatively charged toner having the averaged particle diameter of 6 $\mu$m is used as toner, and a magnetic carrier having the saturation magnetization of 205 emu/cm$^3$ and the averaged particle diameter of 35 $\mu$m is used as the magnetic carrier. The toner and the magnetic carrier are mixed at the weight ratio of 6:94 as the developer used in the present embodiment. Incidentally, the developer is not limited to the mixture of the toner and the magnetic carrier, but a magnetic toner can be used as the developer.

As shown in FIG. 2, the developer circulates in a developer containing portion 4*h*, which is separated into two portions by a separation wall 4*d* formed along the lengthwise direction except both end portions. Agitating screws 4*e*A and 4*e*B are disposed on both the sides of the separation wall 4*d* located between the screws 4*e*A and 4*e*B.

The toner fed from a developer replenishment container 5 (5Y, 5M, 5C or 5K) falls on the rear side of the agitating screw 4*e*B (or on the right side in FIG. 4). As shown in FIG. 4, the fallen toner is agitated while being carried to the front side (or on the left side in FIG. 4). The carried toner passes through the end portion on the front side, where the separation wall 4*d* is not formed. The passed toner is further carried to the rear side in the lengthwise direction (on the right side in FIG. 4) by the agitating screw 4*e*A. The carried toner passes through the end portion on the rear side, where the separation wall 4*d* is not formed. The passed toner is further agitated while being carried to the front side by the agitating screw 4*e*B. Thus, the circulation of the toner is repeated.

Hereinafter, a developing process for visualizing an electrostatic latent image formed on the photosensitive drum 2 with the developing apparatus 4 by a two-component magnetic brush method and the circulation system of the developer are described on the basis of FIG. 2.

The developer in the developer containing portion 4*h* is drawn upon the surface of the development sleeve 4*a* by the drawing pole of the magnet roller 4*b* as the development sleeve 4*a* rotates, and the drawn developer is carried. In the process of the carrying of the developer, the thickness of the developer layer on the development sleeve 4*a* is regulated by the regulating blade 4*c* disposed perpendicularly to the development sleeve 4*a*. Then, a thin layer of the developer is formed on the development sleeve 4*a*. And, when the thin layer of the developer is carried to the developing pole corresponding to the developing portion "c", the growing of ears of the developer (the phenomenon in which particles of the developer are connected with each other in a chain-like state) is formed owing to the magnetic force of the developing pole. The electrostatic latent image on the surface of the photosensitive drum 2 is developed as a toner image by the toner in the developer formed in the state of the growing of ears. Incidentally, the electrostatic latent image is developed by reversal developing in the present embodiment.

The developer in the thin layer state that has passed through the developing portion "c" on the development sleeve 4*a* enters into the developer containing portion 4*h* as the development sleeve 4*a* rotates successively, and then the developer is separated from the development sleeve 4*a* by a repulsive magnetic field of a carrying pole to be returned in the developer containing portion 4*h*.

A direct-current (DC) voltage and an alternative-current (AC) voltage are applied to the development sleeve 4*a* from not shown power sources. In the present embodiment, the DC voltage of −500 V and the AC voltage having the frequency of 2000 Hz and the peak-to-peak voltage of 1500 V are applied to the development sleeve 4*a* to develop only exposed portions on the photosensitive drum 2 selectively.

Generally speaking, in the two-component developing method, when an AC voltage is applied to the development sleeve 4*a*, its development efficiency is increased, and then obtained images come to have high qualities. However, the application of the AC voltage also brings about a disadvantage such that fog becomes easy to produce. Accordingly, an electric potential difference is generally set between the DC voltage to be applied to the development sleeve 4*a* and the surface potential of the photosensitive drum 2 for the prevention of the fog. To put it more concretely, a bias voltage having the largeness between the electric potential in exposed portions on the photosensitive drum 2 and the electric potential in non-exposed portions on the photosensitive drum 2 is applied to the development sleeve 4*a*.

When toner is consumed by development, the toner density in the developer decreases. A sensor 4*g* for detecting the toner density is disposed at a position near the outer periphery surface of the agitating screw 4*e*B in the present embodiment as shown in FIG. 2. When the sensor 4*g* detects the decrease of the toner density in the developer from a predetermined density level, the developer replenishment container 5 (5Y, 5M, 5C or 5K) outputs an order to replenish the developer containing portion 4*h* of the developing apparatus 4 with toner. The toner replenishment operation manages and keeps the toner density in the developer to be always at the predetermined density.

(Developer Replenishment Container)

The developer replenishment containers 5Y, 5M, 5C and 5K are disposed above the process cartridges 1Y, 1M, 1C and 1K, respectively, in parallel with each other. The developer replenishment containers 5Y, 5M, 5C and 5K are mounted in the main body 100 of the printer from the front thereof.

Figure 5:
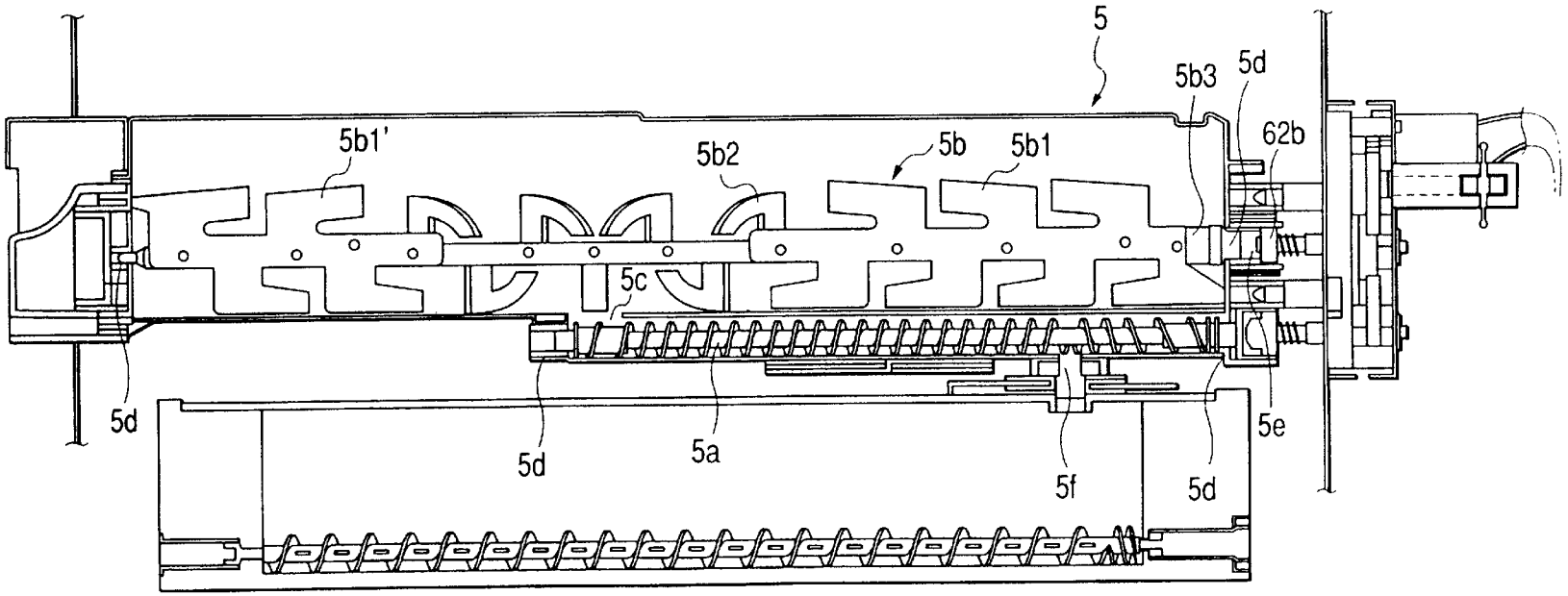
FIG. 5 is a lengthwise direction longitudinal section of the developer replenishment container and the process cartridge according to the present invention.
Figure 6:
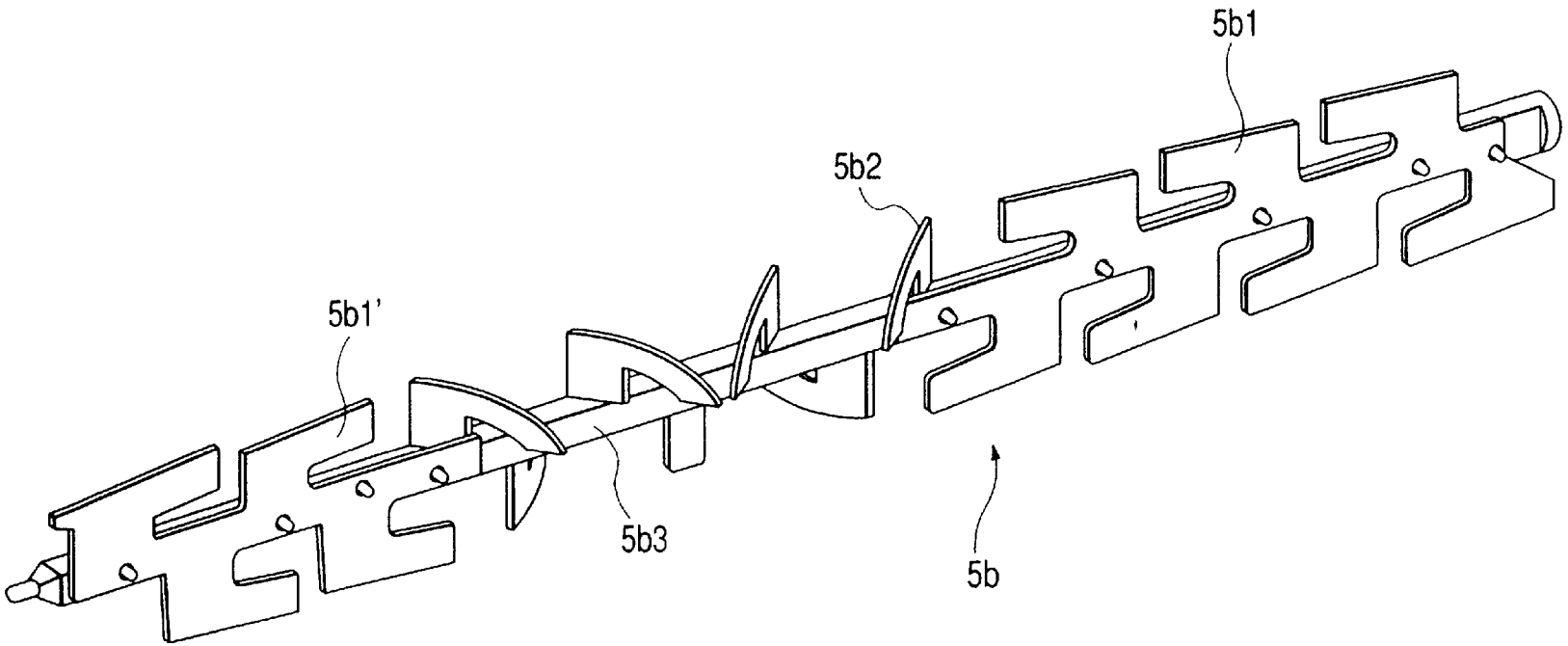
FIG. 6 is a perspective view of a carrying member according to the present invention.

As shown in FIG. 2, the developer replenishment container 5 (5Y, 5M, 5C or 5K) contains a toner or a mixture of a toner and a magnetic carrier in a frame body 5*g* being a developer containing container portion. In the frame body 5*g*, a first carrying member 5*b* and a screw 5*a* being a second carrying member are disposed. As shown in FIG. 6, the first carrying member 5*b* is composed of carrying members 5*b*1 and 5*b*1' attached to a carrying shaft 5*b*3. On the bottom face of the frame body 5*g*, a delivery opening portion 5*f* being a second delivery port for delivering toner to the outside of the developer replenishment containers 5Y, 5M, 5C and 5K is formed. As shown in FIG. 5, both the ends of the screw 5*a* and the carrying shaft 5*b*3 are rotatably supported by bearings 5*d*. Driving couplings (or concave portions) 5*e* are disposed on the most end portions of the screw 5*a* and the carrying shaft 5*b*3 on the rear side (on the right side in FIG. 5).

The driving couplings 5*e* are driven and rotated by receiving driving forces from driving couplings (or convex portions) 62*b* of the main body 100. The outer periphery portion of the screw 5*a* is formed to be a spiral rib shape. The twisting directions of the spiral of the screw 5*a* are reversed at the delivery opening portion 5*f*. The screw 5*a* is rotated by the rotation of the driving coupling 62*b* in a predetermined rotation direction. Then, toner is carried toward the delivery opening portion 5*f*. The toner freely falls down from the delivery opening portion 5*f*. Thereby, the toner is replenished into the process cartridge 1 (1Y, 1M, 1C or 1K).

The first carrying member 5*b* is composed of sheet-like member. The carrying members 5*b*1 and 5*b*1' of the first carrying member 5*b* are configured to have carrying surfaces in parallel with the carrying shaft 5*b*3 in the sate in which no load are borne by on the carrying members 5*b*1 and 5*b*1'. And further, the tip portions of the carrying members 5*b*1 and 5*b*1' in the turning radius direction are configured to incline against the lengthwise direction of the carrying shaft 5*b*3. The tip portions are touched to the inner wall surface of the frame body 5*g* with a certain angle when the tip portions are contacted with the inner wall surface to slide thereon. To put it more concretely, the tip portions of the carrying members 5*b*1 and 5*b*1' are twisted to spirals. The torsion and the inclination of the tip portions generate the carrying forces in the lengthwise direction of the carrying shaft 5*b*3, and toner is carried in the lengthwise direction.

On the other hand, the carrying surfaces of the second carrying member 5*b*2 are previously formed to be twisted to the central axis of the rotation of the carrying shaft 5*b*3 by predetermined angles in the state such that no load is applied to the second carrying member 5*b*2. By the rotation of the carrying shaft 5*b*3 without being touched to the wall surface of the frame body 5*g*, carrying forces in the axial direction are produced. Thereby, toner is carried in the lengthwise directions of the carrying shaft 5*b*3. The carried toner is carried to a developer carrying portion including the screw 5*a* from a first delivery port 5*c* (see FIG. 5).

Incidentally, the developer replenishment container 5 (5Y, 5M, 5C or 5K) according to the present embodiment can replenish toner into not only a process cartridge or a development cartridge using the two-component developing method but also a process cartridge or a development cartridge using one-component developing method. Moreover, pulverulent bodies to be contained in the developer replenishment container 5 (5Y, 5M, 5C or 5K) is not limited to toner, but the developer being a mixture of a toner and a magnetic carrier may be contained therein.

Moreover, although the screw 5*a* being the second carrying member is provided in the developer replenishment container 5 (5Y, 5M, 5C or 5K) in the present embodiment, it may be provided in the main body of a printer or in a process cartridge as long as the most suitable configuration can be designed in view of the performance, the space, the cost, the usability of the whole apparatus.

(Transferring Means)

An intermediate transfer unit 54, which is a transferring means and is shown in FIG. 1, secondarily transfers a plurality of toner images, which have primarily been transferred in order from the photosensitive drums 2 to be superimposed on one another, collectively to a recording medium 52.

The intermediate transfer unit 54 is provided with the aforesaid intermediate transfer belt 54*a*, which travels in the direction indicated by an arrow in FIG. 1. The intermediate transfer belt 54*a* travels at a peripheral velocity substantially same as the outer peripheral velocities of the photosensitive drums 2 in the direction (or the clockwise direction) indicated by the arrow in FIG. 1. The intermediate transfer belt 54*a* is an endless belt having the peripheral length of about 940 mm. The intermediate transfer belt 54*a* is hung around three rollers of a driving roller 54*b*, a secondary transfer opposition roller 54*g* and a follower roller 54*c*.

Moreover, inside the intermediate transfer belt 54*a*, transfer charging rollers 54*f*Y, 54*f*M, 54*f*C and 54*f*K are respectively disposed at positions opposed to the photosensitive drums 2 rotatably. The transfer charging rollers 54*f*Y, 54*f*M, 54*f*C and 54*f*K are pressed toward the centers of the photosensitive drums 2.

The transfer charging rollers 54*f*Y, 54*f*M, 54*f*C and 54*f*K are fed from a not shown high voltage power source, and perform charging the back side of the intermediate transfer belt 54*a* to the reverse polarity of the polarity of toner. Thereby, the transfer charging rollers 54*f*Y, 54*f*M, 54*f*C and 54*f*K primarily transfer the toner images on the photosensitive drums 2 to the upper surface of the intermediate transfer belt 54*a* sequentially.

At a secondary transferring portion, the aforesaid secondary transferring roller 54*d* as a transferring member is pressed to the intermediate transfer belt 54*a* at the position opposed to the secondary transfer opposition roller 54*g*. The secondary transferring roller 54*d* can swing in the vertical direction of FIG. 1 and can rotate. Until the images are successively transferred on the intermediate transfer belt 54*a* to be superimposed on one another and a multi-color image is completed, the secondary transfer belt 54*a* is located to be distant from the intermediate transfer belt 54*a* lest the secondary transfer belt 54*a* should impair the image on the intermediate transfer belt 54*a*.

The intermediate transfer belt 54*a* and the secondary transfer roller 54*d* are severally driven. When a recording medium 2 enters into the secondary transferring portion, a predetermined bias is applied to the secondary transfer roller 54*d*. Thereby, the toner image on the intermediate transfer belt 54*a* is secondarily transferred on the recording medium 52. At this time, the recording medium 2 nipped by both the intermediate transfer belt 54*a* and the secondary transfer roller 54*d* is carried to the left side in FIG. 1 at a predetermined speed while the transferring process is performed. And then, the recording medium 2 is carried to the fixing device 56 for its fixing processing being the next process.

A cleaning unit 55 capable of being touched to and being separated from the surface of the intermediate transfer belt 54*a* is provided at a predetermined position of the intermediate transfer belt 54*a* on the most downstream side of the transferring process. The transfer residual toner remaining after the secondary transferring is removed by the cleaning unit 55.

As shown in FIG. 1, a cleaning blade 55*a* for removing the transfer residual toner is disposed in the cleaning unit 55. The cleaning unit 55 is attached at a not shown rotation center to be swingable. The cleaning blade 55*a* is pressed to the intermediate transfer belt 54*a* in the encroaching direction on the intermediate transfer belt 54*a*. The transfer residual toner taken into the cleaning unit 55 is carried to a not shown waste toner tank by a feeding screw 55*b* to be stored therein.

A belt made of a polyimide resin can be used as the intermediate transfer belt 54*a*. However, the material of the intermediate transfer belt 54*a* is not limited to the polyimide resin, but a plastic such as a polycarbonate resin, a polyethylene terephthalate resin, a polyvinylidene fluoride resin, a polyethylene naphthalate resin, a polyether etherketone resin, a polyether sulfone resin, a polyurethane resin and the like, fluorine-containing rubber and silicone rubber may suitably be used.

(Fixing Portion)

As described above, toner images formed on the photosensitive drums 2 by the developing apparatus 4 are transferred on a recording medium 52 through the intermediate transfer belt 54*a*. Then the fixing device 56 fixes the toner image transferred on the recording medium 52 by means of heat.

As shown in FIG. 1, the fixing device 56 is provided with a fixing roller 56*a* for giving the recording medium 2 heat and a pressuring roller 56*b* for pressing the recording medium 52 to the fixing roller 56*a*. Each of the rollers 56*a* and 56*b* is formed in a shape of a hollowed roller. A not shown heater is set in each of the fixing roller 56*a* and the pressuring roller 56*b*. The driving of the fixing roller 56*a* and the pressuring roller 56*b* to rotate them carries the recording medium 52 at the same time.

That is, the recording medium 52 holding the toner image is carried by the fixing roller 56*a* and the pressuring roller 56*b*, and further the toner image on the recording medium 52 is fixed by receiving the heat and the pressure. Then, the recording medium 52 after the fixation of the toner image thereon is delivered by the delivering rollers 53*h* and 53*j* to be stacked on a tray 57 on the main body 100.

(Mounting of Process Cartridge and Developer Replenishment Container)

Next, the procedures for mounting the process cartridges 1Y, 1M, 1C and 1K and the developer replenishment containers 5Y, 5M, 5C and 5K in the main body 100 are described on the basis of FIGS. 2 to 5.

Figure 3:
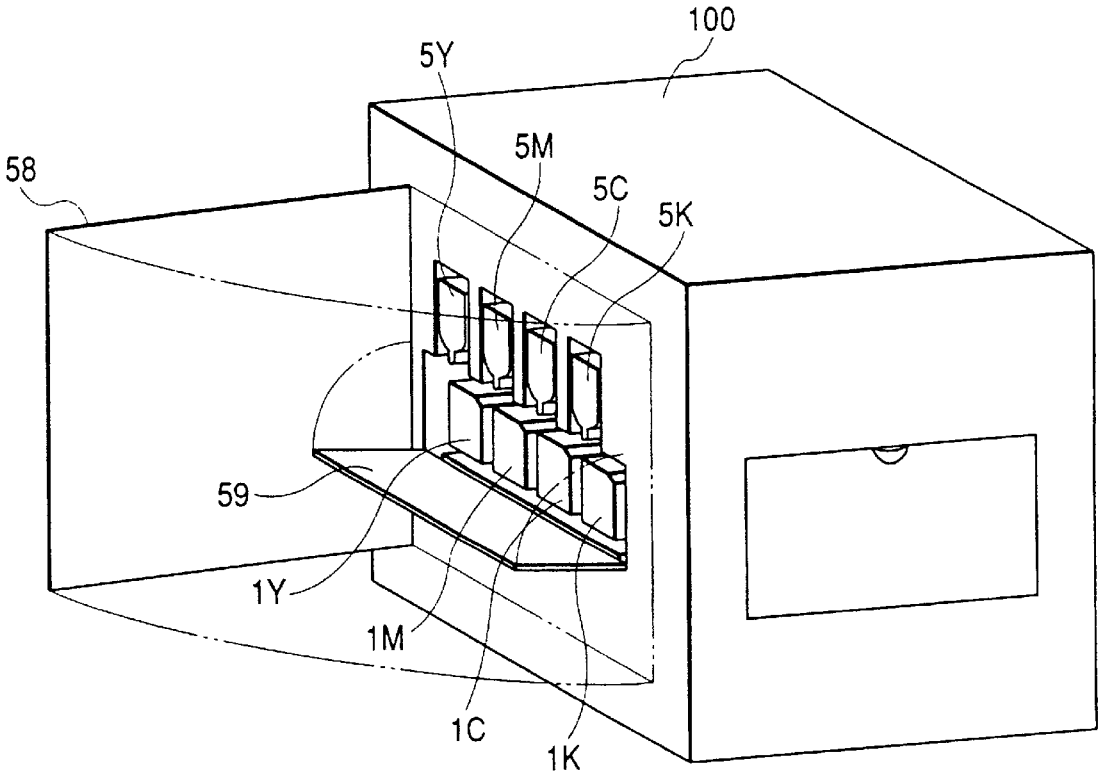
FIG. 3 is a perspective view showing the main body of the image forming apparatus according to the present invention in the state such that the front door of the apparatus is opened.

FIG. 3 is a perspective view showing the main body 100 of the printer. As shown in FIG. 3, a front door 58 capable of being freely opened and closed is disposed at the front of the main body 100. When the front door 58 is opened to the front side, the opening portion through which the process cartridges 1Y, 1M, 1C and 1K and the developer replenishment container 5Y, 5M, 5C and 5K are inserted is exposed.

A core determining plate 59 supported rotatably is disposed at the opening portion, through which the process cartridges 1Y, 1M, 1C and 1K are inserted. The process cartridges 1Y, 1M, 1C and 1K are inserted into and pulled out from the main body 100 after the core determining plate 59 is opened. As shown in FIG. 2, in the main body 100, guide rails 60 for guiding the mounting of the process cartridges 1Y, 1M, 1C and 1K and guide rails 61 for guiding the developer replenishment containers 5Y, 5M, 5C and 5K are provided.

The insertion directions of the process cartridges 1Y, 1M, 1C and 1K and the developer replenishment containers 5Y, 5M, 5C and 5K are in parallel with the axial line directions of the photosensitive drums 2. The guide rails 60 and 61 are disposed in the same directions. The process cartridges 1Y, 1M, 1C and 1K and the developer replenishment containers 5Y, 5M, 5C and 5K are inserted into the main body 100 by being slid from the front side to the rear side of the main body 100 along the guide rails 60 and 61.

When the process cartridges 1Y, 1M, 1C and 1K have been inserted up to the most rear side, as shown in FIG. 4, core determining shafts 66 of the main body 100 are inserted into center holes 2*f* of the drum flanges 2*b*. Thereby, the center positions of the rotations of the photosensitive drums 2 on the rear side are determined to the main body 100. Moreover, at the same time, driving transmitting portions 2*g* formed on the drum flanges 2*b* are coupled with driving couplings (or concave portions) 62*a* of the main body 100. Thereby, it becomes possible to drive and to rotate the photosensitive drums 2.

The driving transmitting portions 2*g* used in the present embodiment have a shape of a twisted triangle pole. Then, when driving forces are applied to the driving transmitting portions 2*g* from the main body 100, the driving forces are transmitted to the photosensitive drums 2, and forces drawing the photosensitive drums 2 into the rear side are produced.

Moreover, as shown in FIG. 4, supporting pins 63 for locating the process cartridges 1Y, 1M, 1C and 1K are disposed on a rear side plate 65. The supporting pins 63 are inserted into the frames 1*a* of the process cartridges 1Y, 1M, 1C and 1K, and thereby the positions of the frames 1*a* of the process cartridges 1Y, 1M, 1C and 1K are fixed.

Moreover, as shown in FIG. 4, on the front side (or the left side in FIG. 4) of the main body 100, the rotatable core determining plate 59 is disposed. To the core determining plate 59, the bearing cases 2*c* of the process cartridges 1Y, 1M, 1C and 1K are fitted, and thereby the process cartridges 1Y, 1M, 1C and 1K are supported and fixed. The performance of the series of insertion operations locates the photosensitive drums 2 and the process cartridges 1Y, 1M, 1C and 1K in the main body 100.

On the other hand, as shown in FIG. 5, when the developer replenishment containers 5Y, 5M, 5C and 5K have been inserted up to the most rear portion similarly to the process cartridges 1Y, 1M, 1C and 1K, the developer replenishment containers 5Y, 5M, 5C and 5K are fixed to the supporting pins 63 protruding from the rear side plate 65. Moreover, at the same time, the driving couplings (or a concave portions) 5*e* are coupled with the driving couplings (or convex portions) 62*b* (see FIG. 5). Thereby it becomes possible to drive and to rotate the screws 5*a* and the carrying shafts 5*b*3.

Incidentally, the drawing out of the process cartridges 1Y, 1M, 1C or 1K or the developer replenishment containers 5Y, 5M, 5C and 5K can be operated by the reverse procedures of the procedures mentioned above.

According to the present embodiment, the process cartridges 1Y, 1M, 1C and 1K and the developer replenishment containers SY, 5M, 5C and 5K can be mounted in or detached from the main body 100 in random order. That is, it is possible to mount the process cartridges 1Y, 1M, 1C and 1K in the main body 100 first, and to mount the developer replenishment containers 5Y, 5M, 5C and 5K in the main body next. It is also possible to mount the developer replenishment containers 5Y, 5M, 5C and 5K in the main body 100 first, and to mount the process cartridges 1Y, 1M, 1C and 1K in the main body next. Moreover, it is possible to draw out the process cartridges 1Y, 1M, 1C and 1K from the main body 100 first, and to draw out the developer replenishment containers 5Y, 5M, 5C and 5K from the main body next. It is also possible to draw out the developer replenishment containers 5Y, 5M, 5C and 5K from the main body 100 first, and to draw out the process cartridges 1Y, 1M, 1C and 1K from the main body next.

Figure 7A:
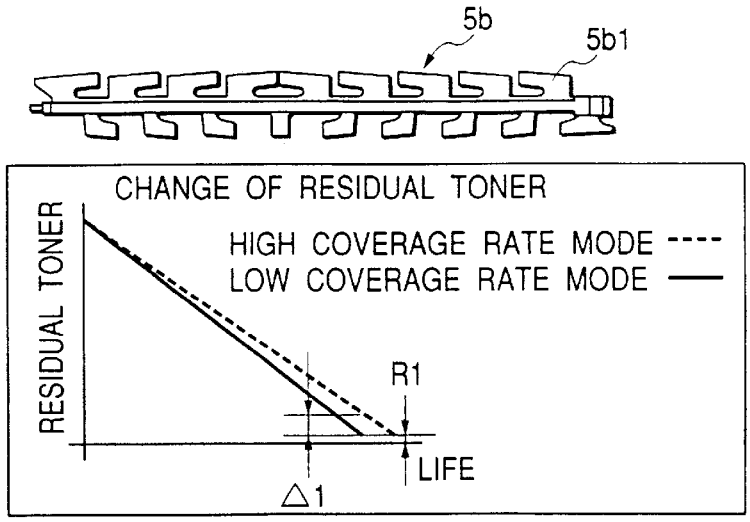
FIGS. 7A, 7B and 7C are diagrams showing the transitions of relations between lives and the amounts of residual toners according to the configurations of the carrying member.
Figure 7B:
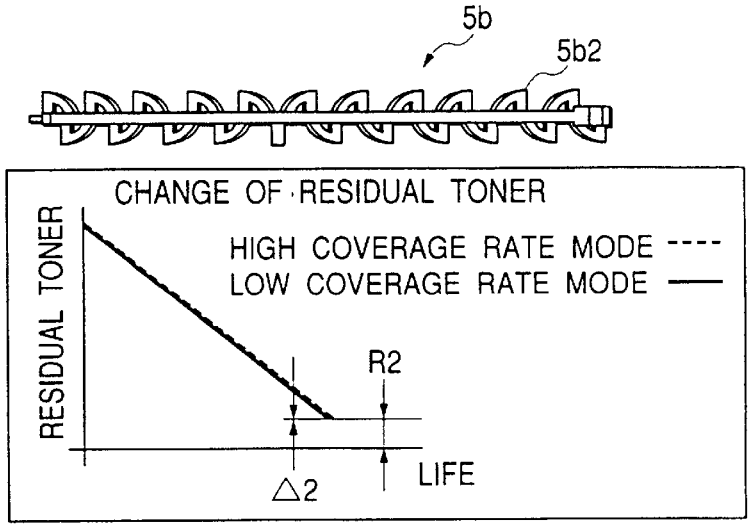
Figure 7C:
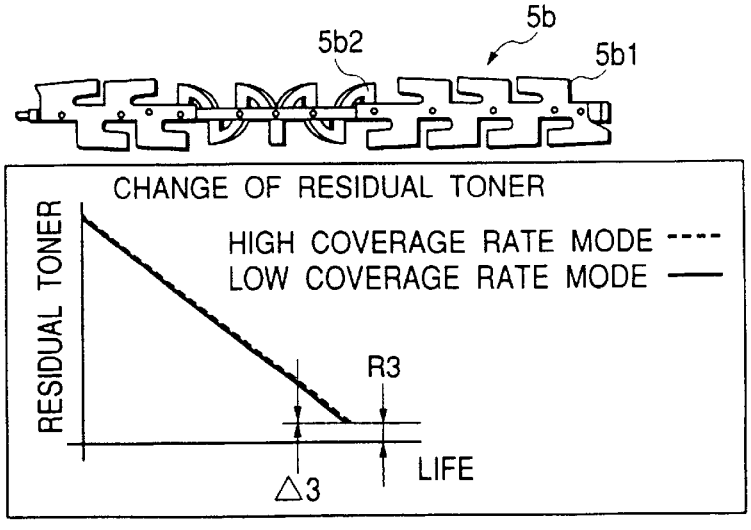

Next, the subject matter of the present invention is described on the basis of FIG. 5, FIG. 6 and FIGS. 7A, 7B and 7C. Incidentally, FIGS. 7A to 7C are diagrams showing the transitions of relations between lives and the amounts of residual toner according to configurations of the carrying member 5*b*.

As described above, the developer replenishment container 5 (5Y, 5M, 5C or 5K) contains a toner or a mixture of a toner and a magnetic carrier in the frame body 5*g* being the developer containing portion. The developer replenishment container 5 (5Y, 5M, 5C or 5K) also rotatably disposes the carrying member 5*b* composed of the first carrying members 5*b*1 and 5*b*1' and the second carrying member 5*b*2, all being fixed to the carrying shaft 5*b*3 in the frame body 5*g*. As described above, the carrying member 5*b* rotates by a driving force from the driving coupling 5*e*. Thereby, the first carrying members 5*b*1 and 5*b*1' and the second carrying member 5*b*2 carry the toner in the inside of the frame body 5*g* toward the first delivery port 5*c*.

The toner delivered from the first delivery port 5*c* is carried to the delivery opening portion 5*f* by the screw 5*a* in the toner carrying portion. Then, the toner freely falls down from the delivery opening portion 5*f* to be replenished in the process cartridge 1 (1Y, 1M, 1C or 1K).

As shown in FIG. 6, both the first carrying members 5*b*1 and 5*b*1' of the carrying member 5*b* are severally made of a sheet member. The first carrying members 5*b*1 and 5*b*1' are deformed by being touched with the inner wall of the developer replenishment container 5 (5Y, 5M, 5C or 5K) or by particle pressures of toner to be twisted. Thereby, the first carrying members 5*b*1 and 5*b*1' produce the carrying forces of toner. Incidentally, polyethylene terephthalate and polyurethane rubber can be selected as the material of the sheets constituting the first carrying members 5*b*1 and 5*b*1'. Other materials suitable in view of the balance of their toner-carrying abilities, their torque and the like can also be selected as the material. Moreover, because the first carrying members 5*b*1 and 5*b*1' are sheet materials, the carrying members 5*b*1 and 5*b*1' are not broken or scraped even if they are touched with the inner wall of the developer replenishment container 5 (5Y, 5M, 5C or 5K). Consequently, it is possible to rake all of the toner in the developer replenishment container 5 (5Y, 5M, 5C or 5K).

On the other hand, the second carrying member 5*b*2 is made of a member having rigidity higher than those of the first carrying members 5*b*1 and 5*b*1'. Each carrying surface of the second carrying member 5*b*2 is disposed to be twisted by the predetermined angle and to form a little gap from the inner wall of the developer replenishment container 5 (5Y, 5M, 5C or 5K) lest the second carrying member 5*b*2 should be touched with the inner wall. Incidentally, in the present embodiment, the second carrying member 5*b*2 is made by the integral molding with the carrying shaft 5*b*3 with a resin. The reason of the employment of the integral molding is that the integral molding is cheaper than the method to fix each carrying surface of the second carrying member 5*b*2 to the carrying shaft.

Because each carrying surface of the second carrying member 5*b*2 has the rigidity and is twisted by the predetermined angle in advance, the rotation of the carrying shaft 5*b*3 generates carrying forces more stable than those of the first carrying members 5*b*1 and 5*b*1'. Because the second carrying member 5*b*2 are disposed in the vicinity of the first delivery port 5*c*, the amount of toner to be delivered from the first delivery port 5*c* becomes stable.

As shown in FIG. 6, the second carrying member 5*b*2 is composed of a plural separate members being a carrying surface severally. The separate members having the shape shown in FIG. 6 have an advantage that manufacturing costs can be suppressed to be cheap at the time of manufacturing them as parts because the structure of a die can be simplified in, for example, an injection molding method.

Moreover, the reason why the first delivery port 5*c* is formed at a position being substantially the center of the developer replenishment container 5 (5Y, 5M, 5C or 5K) in the present embodiment as shown in FIG. 5 is that it is more efficient to carry toner up to the center position than to carry the toner from an end portion of the developer replenishment container 5 (5Y, 5M, 5C or 5K) to the other end portion thereof.

Moreover, although the carrying member is integrally formed with the developer replenishment container 5 (5Y, 5M, 5C or 5K) in the present embodiment, similar advantages can be obtained even if the carrying member is provided in the process cartridge 1 or in the main body 100.

However, it is preferable to configure the carrying member 5*b* integrally with the developer replenishment container 5 (5Y, 5M, 5C or 5K) as in the present embodiment in view of the reduction of the interface portions between the delivery port 5*c* and the feeding portion and the effective use of spaces.

Next, the advantages of the first carrying members 5*b*1 and 5*b*2 of the carrying member 5*b* are described by use of FIGS. 7A to 7C.

FIGS. 7A to 7C are graphs showing the transitions of lives of the carrying members 5*b* (hereupon the total rotation numbers of the screw 5*a*) on their configurations and the total amounts of the residual toner in the developer containing portion in a high coverage rate mode (in which much toner is consumed per one image sheet) and in a low coverage rate mode (in which less toner is consumed per one image sheet). Incidentally, marks Δ1, Δ2 and Δ3 shown in FIGS. 7A to 7C, respectively, show the integrated values of the dispersion in each coverage rate mode (concretely, the dispersion is the difference between the inclination of a graph at the low coverage rate mode and the inclination of a graph at the high coverage rate mode). And marks R1, R2 and R3 indicate the amounts of the residual toner that could not delivered.

FIG. 7A is a graph in the case where the carrying member 5*b* is composed of the first carrying member 5*b*1. The dispersion is designated by the mark Δ1, and the residual toner is designated by the mark R1. FIG. 7B is a graph in the case where all the area of the carrying member 5*b* is composed of the second carrying member 5*b*2. The dispersion is designated by the mark Δ2, and the residual toner is designated by the mark R2. FIG. 7C is the graph in the case where the carrying member 5*b* of the present embodiment is used. The dispersion is designated by the mark Δ3, and the residual toner is designated by the mark R3.

In the configuration shown in FIG. 7A, the following are known. That is, the residual toner R1 is less than the residual toners R2 and R3 of the other configurations shown in FIG. 7B and FIG. 7C, respectively. However, the dispersion Δ1 is larger than the dispersions Δ2 and Δ3 of the other configurations. In such a configuration, it is difficult to stabilize the toner amount in a toner cartridge. Consequently, the configuration has a tendency to be difficult to obtain a high quality image. To put it more minutely, the amounts of rotations of the screw 5*a* do not take a proportional relation between the case where much toner is required at one time and the case where little toner is required at one time according to the detected levels of toner densities by the sensor 4*g* (see FIG. 2). Consequently, it becomes difficult to keep the toner density in the process cartridge 1 constant. Hence, it is not easy to obtain a high quality image.

In the configuration shown in FIG. 7B, it is known that the dispersion Δ2 is small but the residual toner R2 is much. The reason is that, because the carrying member 5*b* is composed of the second carrying member 5*b*2, a gap is needed to be formed between the second carrying member 5*b*2 and the inner wall of the developer replenishment container 5 in view of the prevention of the scrape, the damage, the increase of torque and the like of the second carrying member 5*b*2 and then the toner remained in the gap cannot be raked.

In the configuration shown in FIG. 7C, the dispersion Δ3 is small like the configuration shown in FIG. 7B, and the residual toner R3 is smaller than the residual toner R2. The reason is that, because the second carrying member 5*b*2 is disposed at a position in the vicinity of the delivery port 5*c*, the dispersion R3 is suppressed to be small and the residual toner R3 can be decreased by the formation of the first carrying members 5*b*1 and 5*b*1', which are touched with the inner wall of the developer replenishment container 5, in the other parts.

What is claimed is:

1. A developer carrying member comprising:

a rotation shaft portion;

a first carrying member for carrying developer, said first carrying member being formed on said rotation shaft portion; and a second carrying member for carrying the developer, said second carrying member being formed on said rotation shaft portion on a downstream side in a developer carrying direction, said second carrying member being equipped with a carrying surface having an intersection angle with respect to a lengthwise direction of said rotation shaft portion in a state such that no load is applied to said second carrying member, and such that said second carrying member does not abut against an inner wall of a developer containing container, wherein said first and said second carrying members carry the developer in the lengthwise direction by rotation of said rotation shaft portion, and wherein a rigidity of said second carrying member is higher than a rigidity of said first carrying member.

2. A developer carrying member according to claim 1, wherein said first carrying member is disposed at an end portion of said rotation shaft portion in the lengthwise direction, and wherein said second carrying member is disposed at a central part of said rotation shaft portion in the lengthwise direction.

3. A developer carrying member according to claim 1, wherein said first carrying member is equipped with a carrying surface substantially parallel with said rotation shaft portion in the lengthwise direction in a state such that no load is applied to said first carrying member, and such that a tip portion of said first carrying member in a radial direction of said rotation shaft portion inclines against said rotation shaft portion in the lengthwise direction.

4. A developer carrying member according to claim 3, wherein said developer carrying member is mounted in the developer containing container, wherein said carrying surface is substantially parallel with said rotation shaft portion in the lengthwise direction when said first carrying member is separated from an inner wall of the developer containing container, and wherein said carrying surface is twisted against said rotation shaft portion in the lengthwise direction when said first carrying member contacts the inner wall of the developer containing container.

5. A developer carrying member according to claim 1, wherein said developer carrying member is mounted in the developer containing container, and wherein the developer containing container includes a delivery port for delivering the developer to an outside of the developer containing container, and wherein the delivery port is disposed nearer to said second carrying member than said first carrying member.

6. A developer carrying member according to claim 2, wherein said developer carrying member is mounted in the developer containing container, and wherein the developer containing container includes a delivery port for delivering the developer to an outside of the developer containing container, and wherein the delivery port is disposed at a substantially central portion of said rotation shaft portion in the lengthwise direction.

7. A developer carrying member according to either claim 1 or 2, wherein said first carrying member has a sheet-like shape.

8. A developer carrying member according to either claim 1 or 2, wherein said second carrying member is made from a resin.

9. A developer carrying member according to claim 1, wherein said second carrying member is formed by being integrally molded with said rotation shaft portion.

10. A developer carrying member according to claim 1, said first carrying member is configured to be divided in the lengthwise direction.

11. A developer replenishment container comprising:

a developer containing container for containing developer therein; and a developer carrying member for carrying the developer, said developer carrying member being mounted in said developer containing container, said developer carrying member including:

a rotation shaft portion;

a first carrying member for carrying the developer, said first carrying member being formed on said rotation shaft portion; and a second carrying member for carrying the developer, said second carrying member being formed on said rotation shaft portion on a downstream side in a developer carrying direction, said second carrying member being equipped with a carrying surface having an intersection angle with respect to the lengthwise direction of said rotation shaft portion in a state such that no load is applied to said second carrying member, and such that said second carrying member does not abut against an inner wall of said developer containing container, wherein said first and said second carrying members carry the developer in the lengthwise direction by rotation of said rotation shaft portion, and wherein a rigidity of said second carrying member is larger a rigidity than of said first carrying member.

12. A developer replenishment container according to claim 11, wherein said first carrying member is disposed at an end portion of said rotation shaft portion in the lengthwise direction, and wherein said second carrying member is disposed at a central part of said rotation shaft portion in the lengthwise direction.

13. A developer replenishment container according to claim 11, wherein said first carrying member is equipped with a carrying surface substantially parallel with said rotation shaft portion in the lengthwise direction in a state such that no load is applied to said first carrying member, and wherein a tip portion of said first carrying member in a radial direction of said rotation shaft portion inclines against said rotation shaft portion in the lengthwise direction.

14. A developer replenishment container according to claim 13, wherein said carrying surface is substantially parallel with said rotation shaft portion in the lengthwise direction when said first carrying member is separated from said inner wall, and wherein said carrying surface is twisted against said rotation shaft portion in the lengthwise direction when said first carrying member contacts said inner wall.

15. A developer replenishment container according to claim 12, wherein said developer containing container includes a first delivery port for delivering the developer carried from said first carrying member to said second carrying member to an outside of said developer containing container, and wherein said delivery port is disposed at a central portion in the lengthwise direction.

16. A developer replenishment container according to claim 15, wherein said developer containing container includes:

carrying means for carrying the developer delivered from said first delivery port; and a second delivery port for delivering the developer to the outside, said second delivery port being disposed at said end portion in the lengthwise direction.

17. A developer replenishment container according to either claim 11 or 12, wherein said first carrying member has a sheet-like shape.

18. A developer replenishment container according to either claim 11 or 12, wherein said second carrying member is made from a resin.

19. A developer replenishment container according to claim 11, wherein said second carrying member is formed by being integrally molded with said rotation shaft portion.

20. A developer replenishment container according to claim 11, said first carrying member is configured to be divided in the lengthwise direction.

21. An image forming apparatus comprising:

an image bearing body;

developing means for forming a visual image on said image bearing body with developer; and a developer replenishment container for replenishing the developer to said developing means, said developer replenishment container including:

a developer containing container for containing developer therein; and a developer carrying member for carrying the developer, said developer carrying member being mounted in said developer containing container, said developer carrying member including:

a rotation shaft portion; and a first carrying member for carrying the developer, said first carrying member being formed on said rotation shaft portion; and a second carrying member for carrying the developer, said second carrying member being formed on said rotation shaft portion on a downstream side in a developer carrying direction, said second carrying member being equipped with a carrying surface having an intersection angle with respect to the lengthwise direction of n a state such that no load is applied to said second carrying member, and such that said second carrying member does not abut against an inner wall of a developer containing container, wherein said first and said second carrying members carry the developer in the lengthwise direction by rotation of said rotation shaft portion, and wherein a rigidity of said second carrying member is larger than a rigidity of said first carrying member.

22. An image forming apparatus according to claim 21, wherein said first carrying member is disposed at an end portion of said rotation shaft portion in the lengthwise direction, wherein and said second carrying member is disposed at a central part of said rotation shaft portion in the lengthwise direction.

23. An image forming apparatus according to claim 21, wherein said first carrying member is equipped with a carrying surface substantially parallel with the lengthwise direction in a state such that no load is applied to said first carrying member, and such that a tip portion of said first carrying member in a radial direction of said rotation shaft portion inclines against said rotation shaft portion in the lengthwise direction.

24. An image forming apparatus according to claim 23, wherein said carrying surface is substantially parallel with in the lengthwise direction of said rotation shaft portion when said first carrying member is separated from an inner wall of said developer containing container, and wherein said carrying surface is twisted against the lengthwise direction said rotation shaft portion in the lengthwise direction when said first carrying member contacts said inner wall.

25. An image forming apparatus according to claim 22, wherein said developer containing container includes a first delivery port for delivering the developer carried from said first carrying member to said second carrying member to an outside of said developer containing container, and wherein said delivery port is disposed at a central portion of said rotation shaft portion in the lengthwise direction.

26. An image forming apparatus according to claim 25, wherein said developer containing container includes:

carrying means for carrying the developer delivered from said first delivery port; and a second delivery port for delivering the developer to the outside, said second delivery port being disposed at said end portion in the lengthwise direction.

27. An image forming apparatus according to either claim 21 or 22, wherein said first carrying member has a sheet-like shape.

28. An image forming apparatus according to either claim 21 or 22, wherein said second carrying member is made from a resin.

29. An image forming apparatus according to claim 21, wherein said second carrying member is formed by heavy integrally molded with said rotation shaft portion.

30. An image forming apparatus according to claim 21, said first carrying member is configured to be divided in the lengthwise direction.

* * * * *

UNITED STATES PATENT AND TRADEMARK OFFICE

CERTIFICATE OF CORRECTION

PATENT NO. : 6,701,113 B2
DATED : March 2, 2004
INVENTOR(S) : Kenji Matsuda et al.

It is certified that error appears in the above-identified patent and that said Letters Patent is hereby corrected as shown below:

Column 2,
Line 21, “member” should read -- member which --; and
Line 40, “invention.” should read -- invention; --.

Column 5,
Line 1, “(Cleaner-less” should read -- Cleanerless --.

Column 12,
Line 66, “SY,” should read -- 5Y, --.

Column 14,
Line 56, “not” should read -- not be --.

Column 19,
Line 5, “heavy” should read -- being --.

Signed and Sealed this

Thirteenth Day of July, 2004

JON W. DUDAS
*Acting Director of the United States Patent and Trademark Office*